US006450284B1

(12) United States Patent
Sakyo et al.

(10) Patent No.: US 6,450,284 B1
(45) Date of Patent: Sep. 17, 2002

(54) CAB FOR CONSTRUCTION MACHINERY

(75) Inventors: Tsuyoshi Sakyo, Chiyoda-machi; Toichi Hirata, Ushiku; Takashi Nakagawa, Chiyoda-machi; Akitaka Takeuchi; Kazuhiko Hiraoka, both of Kodaira, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/719,417

(22) PCT Filed: Apr. 7, 2000

(86) PCT No.: PCT/JP00/02258

§ 371 (c)(1),
(2), (4) Date: Dec. 12, 2000

(87) PCT Pub. No.: WO00/63501

PCT Pub. Date: Nov. 26, 2000

(30) Foreign Application Priority Data

Apr. 19, 1999 (JP) ..... 11-110867

(51) Int. Cl.[7] ..... B60K 26/00

(52) U.S. Cl. ..... 180/329; 180/89.12; 180/334; 340/684

(58) Field of Search ..... 180/89.12, 89.13, 180/326, 329, 334; 296/190.01; 340/525, 684, 685

(56) References Cited

U.S. PATENT DOCUMENTS 4,026,379 A * 5/1977 Dunn et al. ..... 180/331
4,478,308 A * 10/1984 Klaassen ..... 180/326
4,699,239 A * 10/1987 Ishino et al. ..... 180/315
4,706,776 A * 11/1987 Hyoki et al. ..... 180/334
5,086,869 A * 2/1992 Newbery et al. ..... 172/414
5,409,079 A * 4/1995 Strong et al. ..... 180/326
5,529,134 A * 6/1996 Yomogita ..... 180/6.2
5,664,637 A * 9/1997 Ohta et al. ..... 180/286
5,924,515 A * 7/1999 Stauffer ..... 180/326
6,148,688 A * 11/2000 Hishimaki ..... 180/272
6,244,369 B1 * 6/2001 Yunoue et al. ..... 180/89.12
6,352,133 B1 * 3/2002 Ojima ..... 180/326

FOREIGN PATENT DOCUMENTS

| | | |
|---|---|---|
| JP | 57-8145 | 1/1982 |
| JP | 62-163561 | 10/1987 |
| JP | 6-27288 | 4/1994 |
| JP | 9-95982 | 4/1997 |
| JP | 9-105150 | 4/1997 |

* cited by examiner

*Primary Examiner*—Paul N. Dickson
*Assistant Examiner*—Faye M. Fleming
(74) *Attorney, Agent, or Firm*—Mattingly, Stanger & Malur, P.C.

(57) ABSTRACT

A cab for a construction machine includes an operator's seat within a cab box. Consoles are provided on the left and right sides of the operator's seat, respectively, and a switch box is provided on an outer side of an operating lever of the right console. Provided on the switch box are a control dial for variably controlling rotational speed of an engine, a working mode selector switch, and a vehicle drive mode selector switch. An operator who is seated on the operator's seat can manipulate the switches on the switch box by stretching a right arm toward the operating lever and by blind touch.

5 Claims, 6 Drawing Sheets

CAB FOR CONSTRUCTION MACHINERY

TECHNICAL FIELD

This invention relates to a cab for construction machine such as, for example, hydraulic excavator, hydraulic crane and the like, and more particularly to a cab for construction machine which is equipped with a console with an operating lever on each side of an operator's seat.

BACKGROUND ART

Generally, construction machines like hydraulic excavators are largely constituted by a vehicular base carrier, an upper rotary body which is rotatably mounted on the lower base carrier, and a working mechanism which is provided on the upper rotary body to lift loads up and down. A cab is provided on a frame of the upper rotary body to serve as an operating room.

A Cab which is provided on prior art hydraulic excavator of this sort basically include a cab box which is provided on the afore-mentioned frame and which internally defines an operating room, and right and left consoles which are located on right and left sides of an operator's seat. Provided on each one of the right and left consoles is an operating lever to be manually turned by an operator who is seated on the operator's seat.

Further, in the case of cab on prior art hydraulic excavator, for example, a control panel mounting an indicator and other instruments is located normally on the right side of an operator who is seated on the operator's seat and distantly on the front side of the above-mentioned console and operating lever (e.g., as disclosed in Japanese Laid-Open Patent Publication No. H9-95982 and H9-105150).

In this case, provided on a front face of the control panel, beneath an indicator area, are various switches to be manually operated by an operator, including a working mode selector switch, a vehicle drive mode selector switch, a head light or lighting switch and a wiper switch. The indicator area of the control panel usually includes an engine cooling water temperature indicator, an operating oil temperature indicator and a fuel meter, along with other indicators displaying, for example, current operating conditions in a working mode selected by the above-mentioned working mode selector switch.

In this connection, difficulties are often encountered with the above-mentioned prior art in which a control panel mounting various switches along with an indicator is located distantly on the front side of a console and an operating lever which are located, for example, on the right side of an operator's seat.

More specifically, in order to manipulate various switches on the control panel, an operator who is seated on the operator's seat is required to lean forward and to reach out his or her arm to put his or her finger tips on a switch on the control panel to manipulate same. Accordingly, under such circumstances, the operator tends to take his or her eyes off a working field in front of the cab and to look at a switch or switches on the control panel.

Therefore, an operator of a hydraulic excavator is often forced to keep a difficult posture or postures, which will add to a great deal of fatigue on the side of the operator and lower the safety of operation because the operator has to shift his or her viewing point from a working field to the control panel from time to time even if the shift is an instantaneous one each time.

Further, the position of the operator's seat in the cab is adjustable on and along a floor surface of the cab.

Accordingly, the consoles and operating levers, which are located at the opposite sides of the operator's seat, are also moved together with the operator's seat. However, since the control panel is located at a certain distance from the consoles and operating levers, adjustments of the operator's seat position change the relative position of the control panel and as a consequence may result in awkward maneuverability of the switches on the control panel.

DISCLOSURE OF THE INVENTION

In view of the above-mentioned problems with the prior art, it is an object of the present invention to provider a cab for construction machine, which is so arranged as to make operation of various manual switches easier for an operator who is seated on an operator's seat in the cab, for lessening the fatigue on the part of the operator.

It is another object of the present invention to provide a cab for construction machine, which is so arranged as to lessen or minimize shifts of a viewing point of operator's eyes at the time of operating manual switches in the cab and to guarantee higher operational safety.

In view of above-discussed problems with the prior art, according to the present invention, there is provided a cab for construction machine which basically including a cab box mounted on a frame structure of a construction machine and internally defining an operating room, an operator's seat provided on a floor panel of the cab box, and right and left consoles located respectively on right and left sides of the operator's seat, each one of the consoles having an operating lever to be pivotally shifted by an operator.

More particularly, according to the present invention, there is provided a cab for construction machine which is characterized in that it comprises: a switch box supported on one of the right and left consoles, at a position in the proximity of the operating lever; and a plural number of switches provided on the switch box for manipulation by the operator in a vehicular drive mode or in a working mode of the construction machine.

With the arrangements just described, an operator who is seated on the operator's seat can easily manipulate the respective switches on the switch box simply by stretching his or her arm toward an operating lever of one of the consoles, for example, of the right console, and can operate the switches by blind touch.

Further, in a preferred form of the present invention, an indicator is located in a position distantly forward of the console and switch box and within a forward view field of an operator on the operator's seat to display thereon operating conditions and modes as set or selected by the switches.

With the arrangements just described, for example, the indicator and the switch box can be located separately in anterior and posterior positions which are both on the right side of the operator's seat but distant from each other. Therefore, while monitoring operating conditions on the indicator which is in a forward view field from the operator's seat, an operator can stretch one arm to manipulate the switches on the switch box.

Further, according to the present invention, speaking in reference to the operator's seat position, the switch box is located in a position on the outer side of the operating lever. With this arrangement, an operator can manipulate the switches on the switch box immediately on the outer side of the operating lever, and by blind touch, with almost the same operational feeling as he or she will have pivotally shifting the operating lever.

On the other hand, speaking in reference to the operator's seat, the switch box is located in a slant position, with a fore end thereof inclined upward toward the front side of the operating lever. With this arrangement, an operator who is seated on the operator's seat can easily confirm the positions of the respective switches on the face of the switch box which is located in a slant position and inclined upward toward its fore end for the purpose of improving manual operation on the respective switches.

Further, according to the present invention, the operator's seat is adjustably mounted on a floor panel of the cab box, and the switch box is arranged to follow a shift in position of the operator's seat together with the console.

With the arrangements just described, an operator can adjust the operator's seat to a comfortable position in a forward or rearward direction or in height, and, at the time of adjustment of the operator's seat, the switch box is moved to follow a shift in position of the operator's seat in a forward or rearward direction or in a vertical direction together with the console to keep constant positional relations between the operator's seat and the switch box.

Further, according to the present invention, a base end portion of the switch box is pivotally supported on the console. With this arrangement, an operator can alter the position of the switch box relative to the console, setting the switch box in a suitable angular position for manipulating the switches on the switch box with finger tips.

BEST MODE FOR CARRYING OUT THE INVENTION

Figure 1:
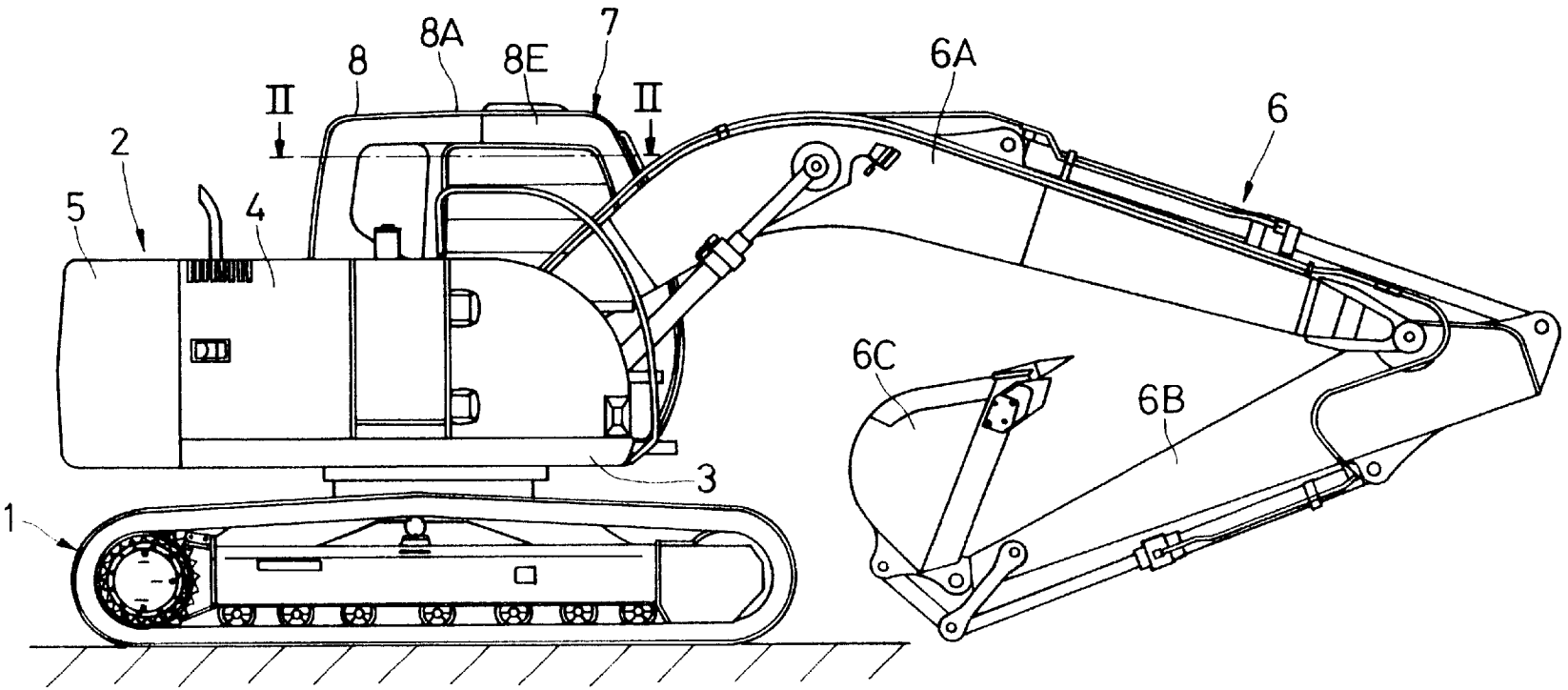
FIG. 1 is a front view of a hydraulic excavator incorporating a cab for construction machine according to the present invention.

Hereafter, with reference to FIGS. 1 through 6, the cab for construction machine according to the present invention is described more particularly by way of a hydraulic excavator, adopted as an example of construction machines to which the present invention is applicable.

In the drawings, indicated at 1 is a vehicular base carrier of the hydraulic excavator, and at 2 an upper rotary body which is rotatably mounted on the vehicular base carrier 1. A rotary frame 3 is provided on the upper rotary body 2, and in turn a cab 7 is provided on the rotary frame 3, as will be described in detail hereinafter. Provided on rear portions of the rotary frame 3 on the rear side of the cab 7 are a housing cover 4 which accommodates an engine and a hydraulic pump (not shown), and a counterweight 5 which is positioned behind the housing cover 4.

Indicated at 6 is a front working mechanism which is provided on a fore center portion of the rotary frame 3 and operative to lift loads up and down. The front working 6 includes a boom 6A, an arm 6B and a bucket 6C, for example, to excavate earth or soil out of ground.

Denoted at 7 is the cab itself which is provided on the rotary frame 3 and which internally defines an operating room. The cab 7 is constituted by a cab box 8 which forms an outer shell of the cab 7, and an operator's seat 13 and consoles 15 and 18 which are provided within the cab box 8. The cab box 8 is formed of, for example, thin steel plates (metal panels) which are assembled together by welding into a box-like shape having top section 8A, front section 8B, rear section 8C and right and left side sections 8D and 8E.

Figure 2:
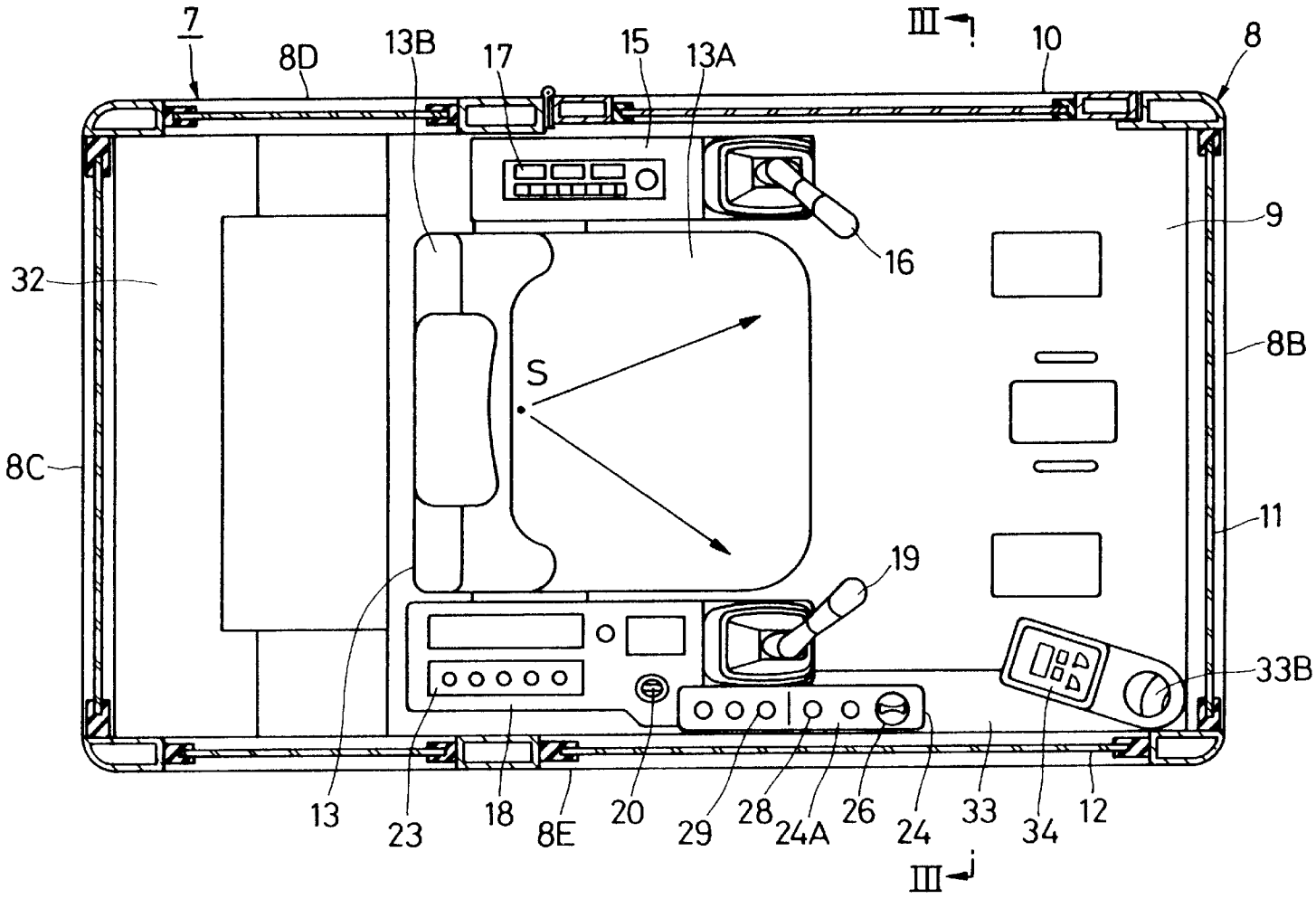
FIG. 2 is an enlarged sectional view taken in the direction of arrows II—II in FIG. 1, showing operator's seat, consoles and switch box which are provided within a cab.
Figure 3:
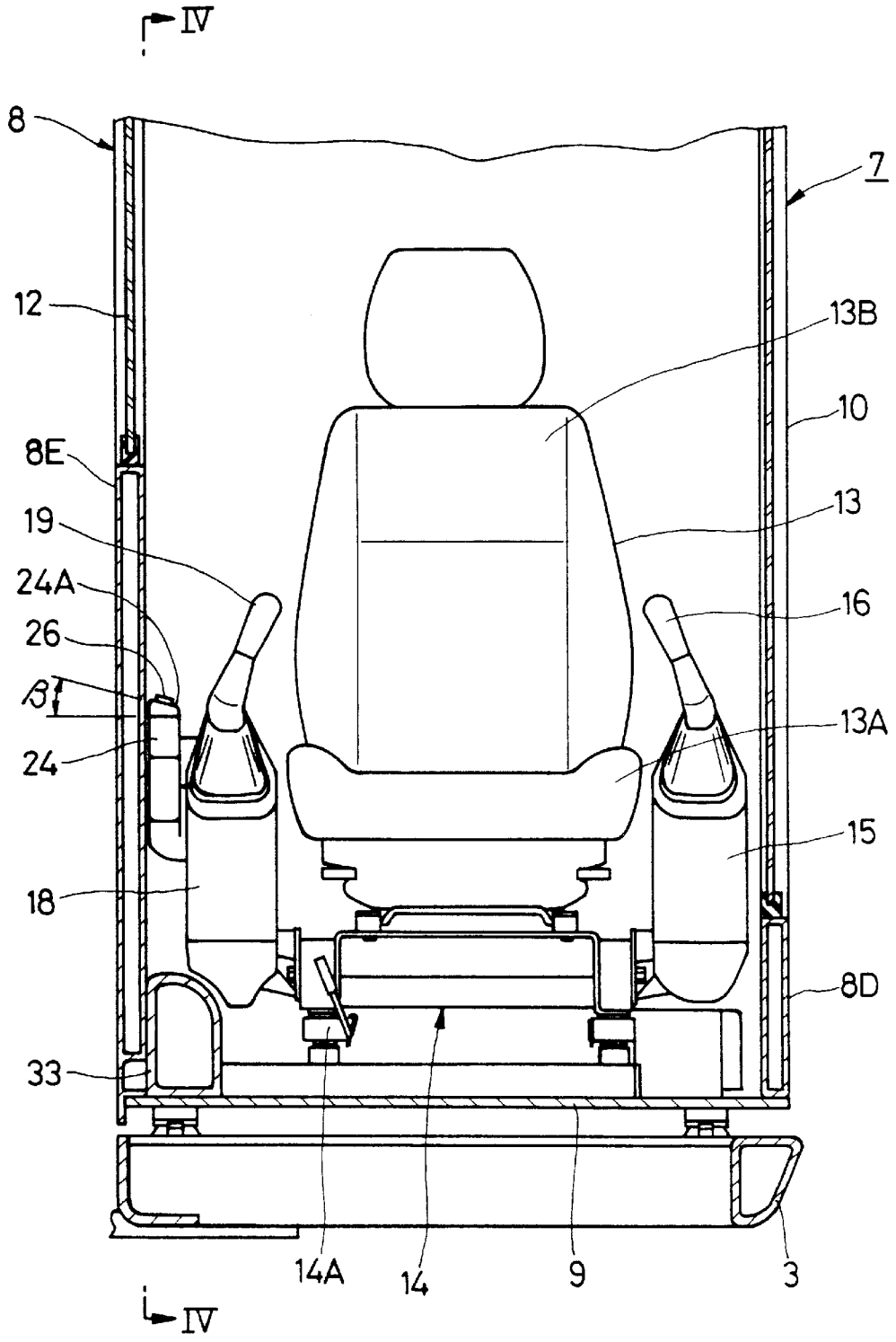
FIG. 3 is a sectional view taken from the direction of arrows III—III in FIG. 2, showing the operator's seat, consoles and switch box in the cab.

Further, on the lower (bottom) side, the cab box 8 is partitioned off by a floor panel 9 which is enclosed by the front section 8B, rear section 8C and side sections 8D and 8E from outside on all sides. Furthermore, as shown in FIGS. 2 and 3, a door 10 is provided in the left side section 8D of the cab box 8 so that an operator can get into and out of the cab 7 through the door opening.

Denoted at 11 is a front window which is provided in the front section 8B of the cab box 8 and which is fitted with a pane of transparent glass to provide a broad view field forward of the cab 7. Indicated at 12 is a side window which is provided in the right side section 8E of the cab box 8, and also fitted with a pane of transparent glass. Accordingly, an operator can secure a broad view field through the side window 12 in the forward or sideward direction.

Figure 4:
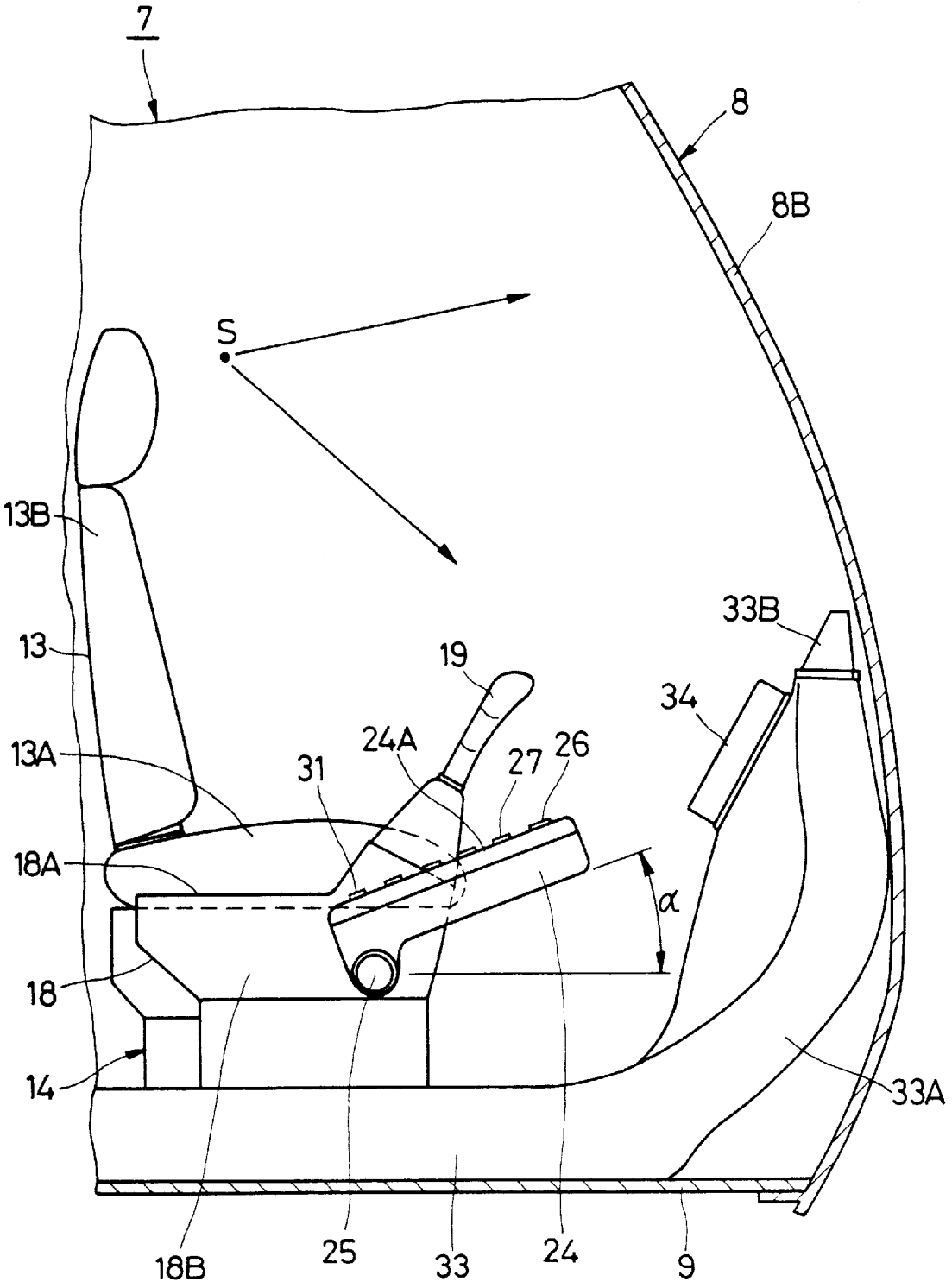
FIG. 4 is a sectional view taken from the direction of arrows IV—IV in FIG. 3, showing positional relations of the operator's seat with the switch box and indicator.

Indicated at 13 is an operator's seat which is provided on the floor panel 9 within the cab box 8. As shown in FIGS. 2 to 4, the operator's seat 13 is constituted by a seat portion 13A which is located substantially at a center portion of the floor panel 9, a back portion 13B which is arranged to stand upward from the rear side of the seat portion 13A, and arm rests (not shown) which are projected forward from opposite lateral side portions of the back portion 13B and extended along the opposite sides of the seat portion 13A. An operator who is seated on the seat portion 13A of the operator's seat 13 can hold a clear view field through the front and side windows 11 and 12 in the directions of arrows, from a viewing point as indicated in FIG. 2, for example, in constantly watching movements of the bucket 6 of the front working mechanism 6.

Designated at 14 is a position adjustor mechanism which is provided between the operator's seat 13 and the floor panel 9 as shown in FIG. 9. This position adjustor mechanism 14 is manually operated by an operator, and provided with a guide rail mechanism 14A for adjusting the position of the operator's seat, for example, by sliding the operator's seat 13 in forward and rearward directions on and along the floor panel 9. Further, the position adjustor mechanism 14 is also provided with a height adjustor mechanism (not shown) for adjusting the height of the seat portion 13A and the inclination angle of the back portion 13B of the operator's seat 13.

Indicated at 15 is a left console which is provided on the left side of the operator's seat 13 and has an operating lever 16 projected in an obliquely upward direction from its upper front end portion as shown in FIGS. 2 and 3. The operating lever 16 is manually turned back and forth by an operator. Further, on the rear side of the operating lever 16, the console 15 is provided with a radio system 17, for example, as shown in FIG. 2.

Indicated at 18 is a right console which is provided on the right side of the operator's seat 13. As seen in FIGS. 2 and 3, the right console 18 similarly has an operating lever 19 projected in an obliquely upward direction from its upper front end portion. The right and left operating levers 19 and 16 are gripped in right and left hands of an operator who is seated on the operator's seat 13, and turned back and forth at the time of operating the boom 6A, arm 6B and bucket 6C of the front working mechanism 6 or at the time of rotating the upper rotary body 2.

Further, an operating lever (not shown) for a vehicle drive is provided on the floor panel 9 of the cab box 8 at a position between the front section 8 and the operator's seat 13. This operating lever is also manually turned by an operator at the time of driving the vehicle in forward or reverse direction or for steering purposes.

Figure 5:
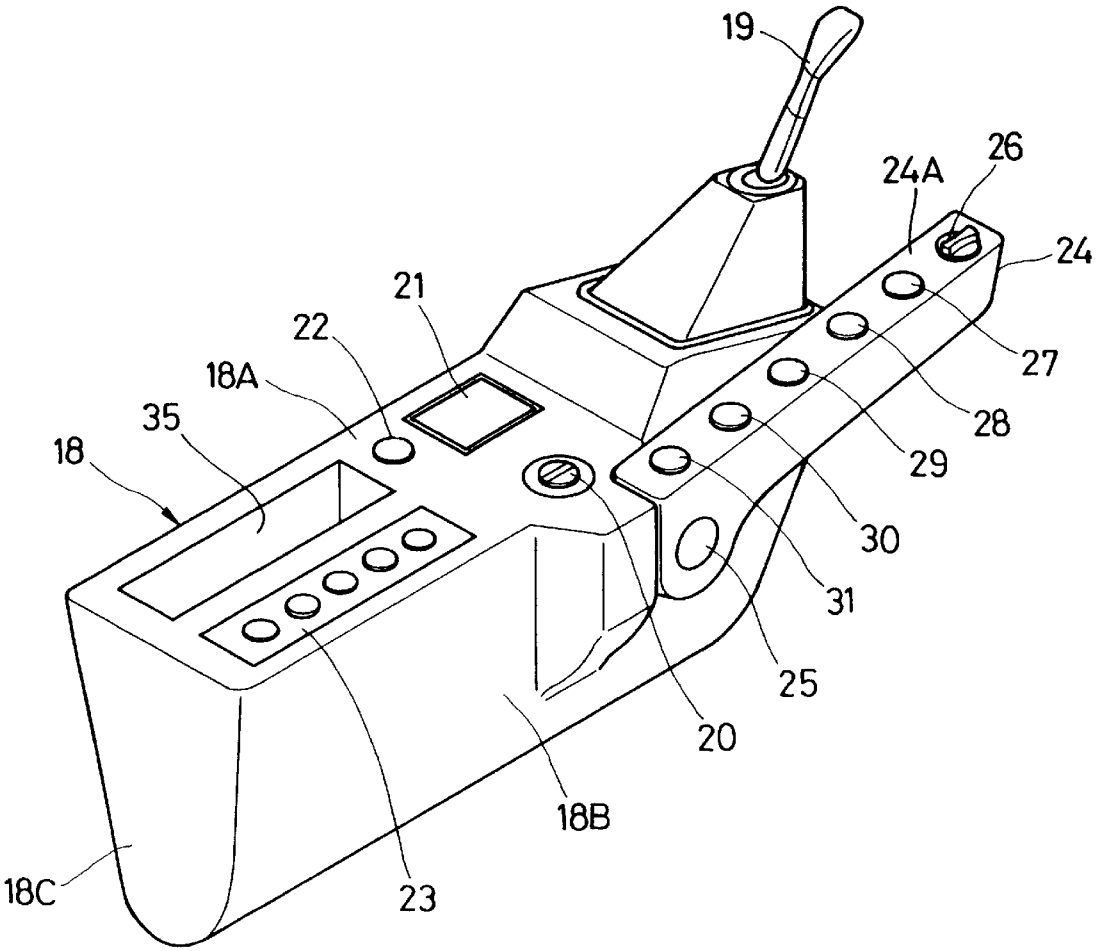
FIG. 5 is a perspective view, showing on an enlarged scale a console of FIG. 2 along with the switch box.
Figure 6:
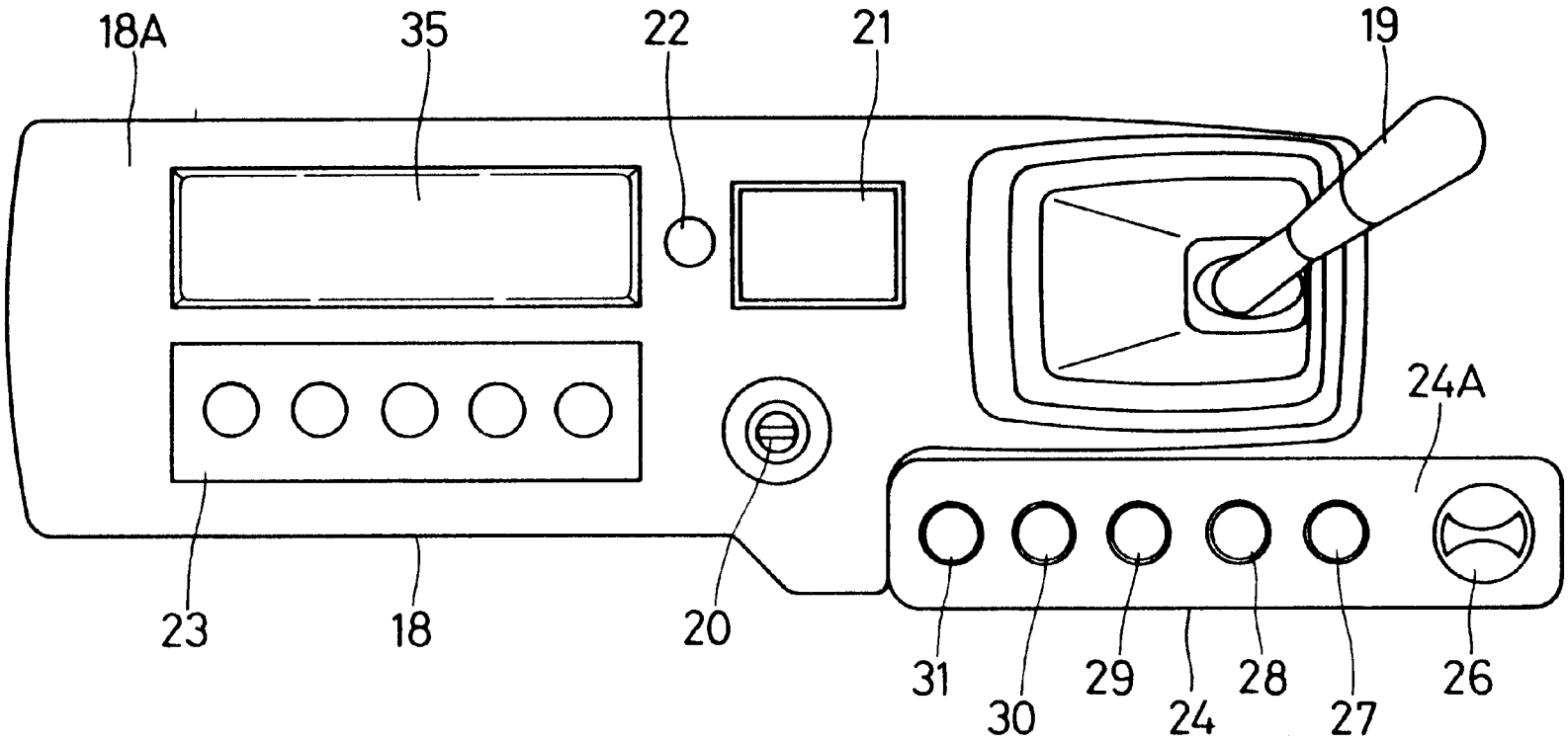
FIG. 6 is a plan view, showing the console and switch box of FIG. 2 on an enlarged scale.

In this instance, as shown in FIG. 3, the right and left consoles 18 and 15 are connected to the right and left sides of the operator's seat 13 through the position adjustor mechanism 14, and are each internally provided with a rigid frame structure (not shown). For example, as shown in FIGS. 5 and 6, the inner rigid frame structure of the right console 18 is covered with a top panel 18A, right and left side panels 18B (the right one alone is shown in FIG. 5), a front panel (not shown) and a rear panel 18C. In this regard, the left console 15 is arranged substantially in the same manner.

The operating lever 19 is projected obliquely upward through a front portion of the top panel 18A of the console 18. In addition, an engine start switch 20, an ashtray 21, a cigar lighter 22 and an air-conditioner controller 23 are provided on the console 18 on the rear side of the operating lever 19. Further, a switch box 24 which is arranged as described below is extended obliquely upward from the right side panel 18B of the console 18 on the outer side of the operating lever 19.

The switch box 24 which is provided on the part of the right side panel 18B is located adjacently on the outer side of the operating lever 19, and, as shown in FIGS. 2 to 6, formed in the shape of a narrow and elongated box. More specifically, on the outer side of the operating lever 19 on the side away from the operator's seat, the switch box 24 is supported on the console 18 at its base end, so to say, in the fashion of a cantilever. The mounting position of the switch box 24 on the console 18 is determined, for example, depending upon ergonomics design data.

In this instance, as shown in FIG. 4, the base end of the switch box 24 is pivotally connected to the side panel 18B of the console 18 by through a connecting pin 25 or the like, while the fore end is extended in an obliquely upward direction with a certain inclination angle $\alpha$ between the right side section 8E of the cab box 8 and the console 18 (or the operating lever 19). Accordingly, an operator can turn the switch box 24 up and down about the connecting pin 25 to adjust the inclination angle $\alpha$ for setting the switch box 24 in a suitable angular position for manipulation of switches. In this regard, it is preferable to set the inclination angle $\alpha$ in the range of 5 to 25 degrees.

Further, provided on the top side 24A of the switch box 24 are switches of hydraulic excavator operating and controlling systems, which are manipulated from time to time when the hydraulic excavator is in travel or at work, for example, switches such as a control dial 26 for variably controlling rotational speed of the engine, an auto-idling control selector switch 27, a working mode selector switch 28 for selecting an operating mode of the working mechanism, a vehicle drive mode selector switch 29, a lighting switch 30 for the head lights or other lighting devices and a wiper switch 31 as shown in FIG. 5.

The above-mentioned control dial 26 and switches 27 to 31 are arranged in a row on the top side of the switch box 24 at intervals in the longitudinal direction thereof. Accordingly, the switch box 24 can be formed in the shape of a long and narrow box, which will permit a high degree of freedom for the interior layout of the cab box 8.

Further, as shown in FIG. 3, the switch box 24 is set in position with the top side 24A inclined at an angle $\beta$ in the transverse direction or toward the operator's seat 13 so that an operator can manipulate the switches in an easy and smooth manner. In case the top side 24A of the switch box 24 is tilted toward the operator's seat 13 in this manner, an operator who is seated on the operator's seat 13 can clearly see the control dial 26 as well as the switches 27 to 31 from above. The above-mentioned inclination angle $\beta$ is preferred to be in the range of 3 to 10 degrees.

Indicated at 32 is a rear cover which is provided within the cab box 8, at a position on the rear side of the operator's seat 13. The rear cover 32 is, for example, made of a synthetic resin material and removably fitted in position between the rear section 8C of the cab box 8 and the operator's seat 13. More specifically, the rear cover 32 serves to cover from above an air-conditioner (not shown) which is mounted on the floor panel 9 behind the operator's seat 13, for aesthetic purposes and at the same time for protecting electrical components or parts from dust and wash water.

Denoted at 33 is an air duct which is located beneath the console 18. As shown in FIGS. 2 to 4, the air duct 33 is extended substantially horizontally along the right section 8E of the cab box 8 and connected at its base end to the air conditioner under the rear cover 32. The opposite fore end of the air duct 33 is bent in upward direction along the front section 8B of the cab box 8 to form a riser portion 33A as shown in FIG. 4. Provided at the top end of riser portion 33A of the duct 33 is a warm/cool air outlet 33B.

In this instance, by warm or cool air which is suppled to the cab box 8 through the air outlet 33B of the duct 33, the temperature within the cab 7 can be adjusted to a most comfortable level for the operator. Part of air from the air outlet 33B is also supplied toward the front and side windows 11 and 12 to prevent fogging of window panes.

Indicated at 34 is an indicator for monitor, for example, a small LCD type display, which is integrally mounted on the riser portion 33A of the air duct 33 for monitoring purposes, at a position beneath the air outlet 33B of the latter and distantly on the front side of the console 18 and switch box 24. Further, as shown in FIG. 2, the indicator 34 is located in the vicinity of a corner portion between the front and side sections 8B and 8E of the cab box 8, and, in order not to block the view field in the forward direction of an operator seated on the operator's seat 13, the indicator 34 is arranged to have a limited width which substantially corresponds to the width of the afore-mentioned corner portion of the cab box 8.

Further, as shown in FIG. 4, the top face of the indicator 34 is inclined toward the operator's seat, so that the indicator 34 falls within a forward view field from a viewing point S of an operator who is seated on the operator's seat, as indicated by arrows in FIG. 4, and can be constantly monitored by the operator. For example, the indicator 34 is arranged to indicate readings in engine cooling water temperature, operating oil temperature and amount of residual fuel, along with current operating positions of the auto-idling control selector switch 27 and the working mode selector switch 28.

Indicated at 35 is a container box which is provided in the top panel 18A of the console 18 side by side with the controller 23. This container box 35 is used, for example, for holding small items such as soft drinks, towel etc.

With the arrangements as described above, the hydraulic excavator according to the present embodiment is operated in the manner as described below.

Firstly, by an operator which has seated on the operator's seat 13 in the cab 7, the vehicle drive operating lever is turned to and fro to drive the base carrier 1 in forward and reverse directions, for example, on a working ground. At the time of a soil excavating operation, by manually shifting the right and left operating levers 16 and 19 the boom 6A and arm 6B of the front working mechanism 6 are lifted up and down while the bucket 6C is swung back and forth to excavate and scoop soil on the front side of the bucket 6C.

In this instance, according to the present embodiment, of the two consoles 15 and 18 which are provided on the right and left sides of the operator's seat 13, the switch box 24 is attached to the outer side of the right console 18 in the fashion of a cantilever and located as close as possible to the right operating lever 19, as shown in FIGS. 2 and 5. On the switch box 24 are the control dial 26 for variably controlling rotational speed of the engine, an auto-idling control selector switch 27, an working mode selector switch 28, vehicle drive mode selector switch 29, head light or lighting switch 30 and wiper switch 31.

Therefore, for example, a right-handed operator who has seated on the operator's seat 13 can easily manipulate the operating lever 19 as sell as the control dial 26 and other switches 27 to 31 on the switch box 24 which is located in the proximity of the operating lever 19, simply by stretching his or her right arm toward the console 18. Accordingly, the operator can manipulate the control dial 26 and switches 27 to 31 by blind touch.

In this case, the right and left operating levers 16 and 19 which are provided on the right and left consoles 15 and 18 are frequently manipulated by an operator when the hydraulic excavator is in an excavating operation, so that they are located in positions which are most handy and suitable for manipulation by an operator who is seated on the operator's seat 13. Considering that operators are mostly right-handed, the switch box 24 is located on the outer side of the right console 18 in the vicinity of the right operating lever 19.

Accordingly, an operator on the operator's seat 13 can easily and smoothly manipulate the control dial 26 and switches 27 to 31 on the switch box 24 with almost the same operational feeling as he or she would have when switching the operating lever 19 back and forth. Besides, the operator can manipulate the respective switches by blind tough, without shifting his or her eyes off a view forward of the cab 7 (e.g., off the front working mechanism 6 etc.).

Further, the fore end of the switch box 24 is tilted upward in a direction forward of the operating lever 19 with an inclination angle $\alpha$ relative to the operator's seat, and at the same time the upper face 24A of the switch box 24 is slightly tilted toward the operator's seat 13 with an inclination angle $\beta$ in the transverse direction. Therefore, an operator who is seated on the operator's seat 13 can easily confirm the positions of the control dial 26 and switches 27 to 31 on the slant face of the switch box 24, in addition to the easiness of manipulation of the control dial 26 and the switches 27 to 31.

On the other hand, within a corner portion between the front and side sections 8B and 8E of the cab box 8, the monitoring indicator 34 is located in a position which is distantly forward of the right console 18 and the switch box 24, within a forward view field from a viewing point S of an operator who is seated on the operator's seat 13 as shown in FIG. 2. By way of the indicator 34, one can monitor the readings in engine cooling water temperature, operating oil temperature and fuelometer, along with information regarding current operating conditions of the working mode selector switch 28.

The indicator 34 and the switch box 24 are located separately in anterior and posterior positions on the right side of the operator's seat 13, so that, while monitoring operating conditions on the indicator 34 which is within a forward view field from the operator's seat 13, an operator can manipulate the control dial 26 and switches 27 to 31 simply by stretching out his or her arm toward the switch box 24.

The above-described arrangements contribute to lessen the fatigue on the side of an operator to a significant degree because, in manipulating switches, an operator is not forced to take a difficult posture as in the prior art mentioned hereinbefore. In addition, during manipulation of switches, an operator can constantly read operating conditions of the machine from the indicator 34, which is located within a forward view field of the operator, to operate the machine in a safe and secure manner, for example, checking for movements of the bucket 6C of the front working mechanism 6 concurrently with monitoring operating conditions which are displayed on the indicator 34.

Further, the position adjustor mechanism 14 is provided between the cab box floor panel 9 and the operator's seat 13 thereby to shift the position of the operator's in forward or rearward direction on and along the floor panel 9 or to adjust the height of the operator's seat in the vertical direction together with the console 18 and the switch box 24.

Therefore, according to the body size of an operator, the position of the operator's seat 13 can be adjusted in a forward or rearward direction or in a vertical direction by way of the position adjustor mechanism 14, and set in most comfortable position for each operator. At the time of adjustment of the operator's seat 13, the switch box 24 is moved in a forward or rearward direction or in a vertical direction together with the console 18, constantly keeping the same positional relations with the operator's seat 13 to permit the operator to continue blind touch switch operations.

Further, the base end of the switch box 24 is attached to the console 18 through the connecting pin 25 as shown in FIG. 4, so that an operator can turn the switch box 24 up and down about the connecting pin 25 for the purpose of adjusting the switch box 24 to an inclination angle $\alpha$ which is best suited for manipulation of the respective switches.

Accordingly, depending upon personal fondness, the position of the switch box 24 relative to the console 18 can be altered to suit each operator for manipulating the control dial 26 and switches 27 to 31 with finger tips. Further, considering that most of machine operators are right-handed, the switch box 24 is located on the right side of the operator's seat, permitting to manipulate the respective switches smoothly with a right hand, including control dial 26 for variably controlling rotational speed of the engine, the auto-idling control selector switch 27, working mode selector switch 28, vehicle drive mode selector switch 29, head light or lighting switch 30 and wiper switch 31.

Thus, according to the present embodiment, of the consoles 18 and 15 which are located on the right and left sides of the operator's seat 13 within the cab box 8, the switch box 24 is provided, for example, on the right console 18 at a position in close proximity to the operating lever 19, so that an operator who is seated on the operator's seat 13 can manipulate the switches on the switch box 24 smoothly without taking a difficult posture and with less fatigue.

Further, the control dial 28 and switches 27 to 31 on the switch box 24, which is located in the vicinity of the operating lever 16, can be manipulated by blind touch. It follows that, there is almost no need for the operator to take his or her eyes off a forward view field from the operator's seat at the time of operating the manual switches and can monitor current operating conditions of the front working mechanism 6 to carry on machine operations in a highly safe manner. In addition, the above-described arrangements contribute to minimize the shifts of a viewing point to lessen the fatigue on the part of the operator to a marked degree.

In the foregoing embodiment, by way of example the switch box 24 is attached to the console 18 on the right side of the operator's seat 13. However, it is to be understood that the present invention is not limited to this particular arrangement. For example, the switch box 24 may be provided on the left console 15 if desired. Alternatively, a similar switch box may be provided on both of the right and left consoles 18 and 15.

Further, in the foregoing embodiment, the switch box 24 is vertically pivotally connected at its base end to a lateral side of the console 18 through the connecting pin 25. However, the present invention is not limited to this particular arrangement. For example, the switch box may be fixed in a predetermined position which is compliant with ergonomics data.

Furthermore, in the foregoing embodiment, the cab for construction machine according to the present invention is applied by way of example to a hydraulic excavator. However, the present invention is not limited to this particular application, and can be similarly applied to other construction machines such as hydraulic cranes and wheel type hydraulic excavators. The construction machine cab according to the present invention is also applicable to dredge ships having a rotary body and a working mechanism on a deck.

INDUSTRIAL APPLICABILITY

As described in detail hereinbefore, according to the present invention, there is provided a cab for a construction machine, having a console provided on each side of an operator's seat within a cab box, a switch box provided on one of the consoles at a position in the vicinity of an operating lever, and a plural number of manual switches provided on the switch box to permit manipulation by an operator for switching operations of the machine in a vehicular drive mode or in a working mode. With these arrangements, an operator who is seated on the operator's seat can easily manipulate operation control or selector switches simply by stretching an arm toward the switch box which is located, for example, in the vicinity of a right one of the two consoles, in such a way as to permit blind touch manipulating of the switches.

Accordingly, an operator who is seated on the operator's seat is not forced to take a difficult posture in manipulating the switches, that is to say, the operator is allowed to manipulate the switches smoothly in a safe manner and with less fatigue. Since each one of the switches on the switch box can be manipulated in the vicinity of the operating lever, the operator is not required to take his or her eyes off a working field forward of the cab box. This means that the operator can pay attention continuously to a front working mechanism to check for any change in its operating conditions and can control operations of the machine in a safer manner.

Further, according to the present invention, an indicator or monitor is located in the cab box at a position distantly forward of the console and switch box and falling within a forward view field of an operator who is seated on the operator's seat, to indicate thereon current operating conditions or mode set or selected by various switches. Therefore, for example, the indicator and switch box can be located separately on the right side of the operator's seat, so that an operator can manually operate the various switches on the switch box simply by stretching one arm thereto while checking for readings on the indicator which is located within a forward view field from the operator's seat.

Further, according to the present invention, speaking in reference to the operator's seat position, the switch box is located on the outer side of an operating lever to permit an operator to manipulate various switches on the switch box with almost the same operational feeling as he or she would have when pivotally shifting the operating lever up and down. In addition, the operator can manipulate the switches by blind touch without taking his or her eyes off a working mechanism or equipments in front of the cab box.

On the other hand, according to the present invention, speaking in reference to the operator's seat position, the switch box is located in a slant position, with a top face of the switch box turned obliquely upward toward the front side of the operating lever so that an operator who is seated on the operator's seat can easily confirm the positions of the switches on the top face of the switch box which is turned toward the operating lever and can manipulate the switches by blind touch.

Further, according to the present invention, the operator's seat is adjustably mounted on a floor panel of the cab box, and, upon adjustment of the operator's seat, the switch box is moved to follow the operator's seat along with the console. Accordingly, when the operator's seat is adjusted by an operator to a most comfortable position in a forward or rearward direction and/or in height according to his or her body size, the switch box is simultaneously adjusted in a forward or rearward direction and/or in height together with the console, keeping constant positional relation with the operator's seat to permit blind touch switch operations by the operator.

Further, according to the present invention, the switch box has a base end portion pivotally supported on a console so that an operator can turn the switch box to a suitable angular position relative to the console for manipulating the switches with finger tips. This arrangement contributes to improve maneuverability and controllability of the construction machine.

What is claimed is:

1. A cab for a construction machine including a cab box mounted on a frame structure of a construction machine and internally defining an operating room, an operator's seat provided on a floor panel of said cab box, and right and left consoles located respectively on right and left sides of said operator's seat, each one of said consoles having an operating lever at its front portion to be pivotally shifted by an operator, characterized in that said cab comprises:

a switch box having a base end portion supported on one of said right and left consoles at a position in the proximity of said operating lever and having a fore end portion extended forward of said console, said base end portion of said switch box being pivotally connected to said console in the fashion of a cantilever;

said switch box being disposed in a slanting direction and inclined upwardly toward the front side of said operating lever with respect to said operator's seat position; and a plural number of switches provided on said switch box for manipulation by said operator when said construction machine is in a vehicular drive mode or in a working mode.

2. A cab for a construction machine as defined in claim 1, further comprising an indicator located in a position spaced forwardly of said console and switch box and within a forward field of view of an operator on said operator's seat to display thereon operating conditions and modes set or selected by said switches.

3. A cab for a construction machine as defined in claim 1, wherein said switch box is located in a position on the outer side of said operating lever with respect to a position of said operator's seat.

4. A cab for a construction machine as defined in claim 1, wherein said operator's seat is adjustably mounted for straight back and forth movement on a floor panel of said cab box, and said switch box is arranged to follow a shift in position of said operator's seat together with said console.

5. A cab for a construction machine including a cab box mounted on a frame structure of a construction machine and internally defining an operating room, an operator's seat provided on a floor panel of said cab box, and right and left consoles located respectively on right and left sides of said operator's seat, each one of said consoles having an operating lever at its front portion to be pivotally shifted by an operator, characterized in that said cab comprises:

a switch box having a base end portion supported on one of said right and left consoles at a position in the proximity of said operating lever and having a fore end portion extended forward of said console;

said base end portion of said switch box being pivotally connected to said console in the fashion of a cantilever; and a plural number of switches provided on said switch box for manipulation by said operator when said construction machine is in a vehicular drive mode or in a working mode.

* * * * *